US007510184B2

(12) United States Patent
Kaya

(10) Patent No.: US 7,510,184 B2
(45) Date of Patent: Mar. 31, 2009

(54) PAPER THICKNESS MEASURING DEVICE FOR A ROTARY PAPER FEEDING DEVICE

(75) Inventor: Mehmet Oktay Kaya, Lee, NH (US)

(73) Assignee: Goss International Americas, Inc., Durham, NH (US)

( * ) Notice: Subject to any disclaimer, the term of this patent is extended or adjusted under 35 U.S.C. 154(b) by 480 days.

(21) Appl. No.: 11/137,990

(22) Filed: May 25, 2005

(65) Prior Publication Data

US 2006/0266241 A1 Nov. 30, 2006

(51) Int. Cl.
*B65H 5/02* (2006.01)
*B65H 7/12* (2006.01)

(52) U.S. Cl. ..... 271/277; 271/262; 271/263; 271/176; 271/265.04

(58) Field of Classification Search ..... 271/262, 271/263, 265.04, 176, 277, 314
See application file for complete search history.

(56) References Cited

U.S. PATENT DOCUMENTS 2,643,113 A * 6/1953 Williams ..... 270/56
4,078,784 A * 3/1978 Miaskoff et al. ..... 270/56
4,127,266 A * 11/1978 Williams ..... 271/263
4,378,109 A 3/1983 Takahashi et al.
4,836,528 A * 6/1989 Geiser ..... 271/263
5,833,229 A * 11/1998 Prim ..... 271/11
2002/0139728 A1 10/2002 Kim

FOREIGN PATENT DOCUMENTS

JP 07069517 A * 3/1995

* cited by examiner

*Primary Examiner*—Patrick H Mackey
*Assistant Examiner*—Luis Gonzalez
(74) *Attorney, Agent, or Firm*—Davidson, Davidson & Kappel, LLC

(57) ABSTRACT

A paper thickness measuring device for use in a rotary paper feeding device having a rotating cylindrical drum. In a preferred embodiment of the present invention, a gripper is mounted on the cylindrical drum for gripping a sheet; and a target is mounted on the cylindrical drum and mechanically linked to the gripper such that a position of the target corresponds to displacement of the gripper by a gripped sheet. The target is arranged and configured for detection of the target position a predetermined time or at a downstream location after the gripper grips a sheet.

9 Claims, 3 Drawing Sheets

PAPER THICKNESS MEASURING DEVICE FOR A ROTARY PAPER FEEDING DEVICE

BACKGROUND OF THE INVENTION

Modern mail room operations are arranged to process mass distribution mailings that may involve the mailing of many individual mail items, each containing one, two, three or more pages. The operation typically includes machines and devices to feed, fold, transport and insert pages into envelopes for eventual mailing. A rotary paper feeding device comprises a rotating cylindrical drum arranged to grip a number of pages for each mail item, for delivery to, for example a folding machine. In connection with the operation of the paper feeding device, it is desirable to measure the thickness of each item gripped by the device, to make certain that the proper number of pages is being delivered to the folding machine.

To that end, various mechanical devices have been provided on the rotating cylinder to press the gripped paper toward the cylinder drum to sense the thickness and thereby determine the number of pages being gripped by the rotating cylinder. The accuracy of the measurement is dependent upon mechanical action of a number of interconnected mechanical devices.

Another prior proposal for determining the number of pages gripped by the rotating cylinder comprises a sensing device in the rotating cylindrical drum to sense the thickness of the gripped pages. The sensing device then transfers the sensed data to a fixed receiving device mounted adjacent to the rotating cylinder. This arrangement requires the use of complex sensing equipment, and also involves an angular delay between sensing the thickness, and the transfer of the data to the fixed receiving device.

Thus, the known mechanisms for sensing the number of pages being feed to a device such as a folding machine have deficiencies that would be advantageous to overcome.

SUMMARY OF THE INVENTION

The present invention provides a new and improved paper thickness measuring device adapted to measure the thickness of a sheet being gripped and fed by a rotating cylinder drum of a rotary paper feeding device.

In a preferred embodiment of the present invention, a paper thickness measuring device is arranged for use in a rotary paper feeding device having a rotating cylindrical drum. A gripper is mounted on the cylindrical drum for gripping a sheet;

and a target is mounted on the cylindrical drum and mechanically linked to the gripper such that a position of the target corresponds to displacement of the gripper by a gripped sheet. The target is arranged and configured for detection of the target position a predetermined time or at a downstream location after the gripper grips a sheet.

In another preferred embodiment of the present invention, a rotary paper feeding device comprises a rotating cylindrical drum and a gripper mounted on the cylindrical drum for gripping a sheet. Pursuant to a feature of the present invention, a target is mounted on the cylindrical drum and mechanically linked to the gripper such that a position of the target corresponds to displacement of the gripper by a gripped sheet. The target is arranged and configured for detection of the target position a predetermined time or at a downstream location after the gripper grips a sheet.

In a further embodiment of the present invention, a method for measuring the thickness of a sheet being gripped by a rotary paper feeding device comprises the steps of providing a rotating cylindrical drum, providing a gripper mounted on the cylindrical drum for gripping a sheet such that the gripper is displaced upon gripping a sheet, and mechanically linking the gripper to a target mounted on the cylindrical drum to cause a position of the target to correspond to displacement of the gripper by a gripped sheet. The method includes the step of arranging the target for detection of the target position a predetermined time or at a downstream location after the gripper grips a sheet.

DETAILED DESCRIPTION OF THE PREFERRED EMBODIMENTS

Figure 1:
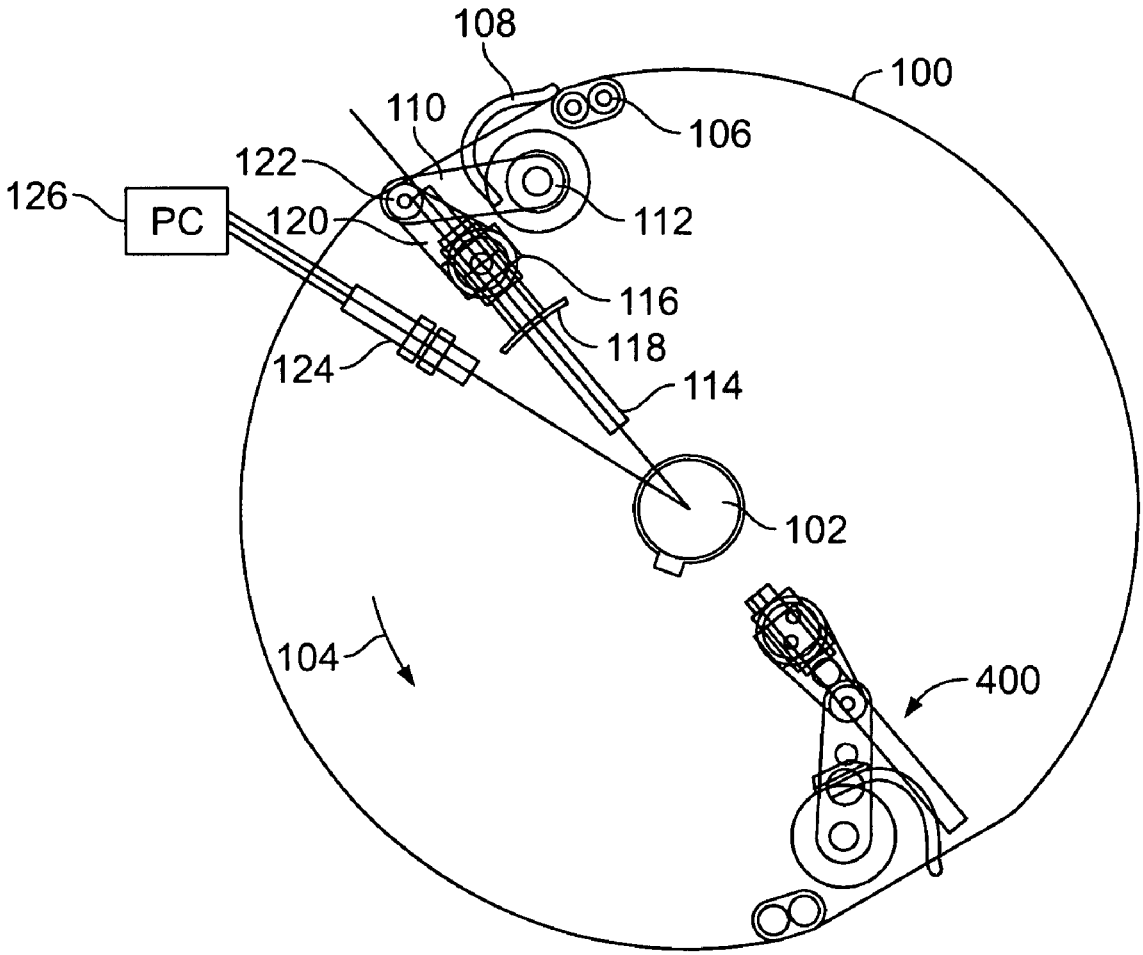
FIG. 1 is a side view of a rotating cylinder for gripping and delivering paper pages and including a paper thickness measuring device according to an exemplary embodiment of the present invention.

Referring now to the drawings, and initially to FIG. 1, there is illustrated a rotating cylinder drum 100 for gripping and delivering paper pages to a subsequent device (not illustrated). The drum 100 is rotatably mounted on a support shaft 102 for rotation in a preselected direction 104. A seat structure 106 is mounted at a peripheral surface of the drum 100. The seat structure 106 is arranged to provide a receiving surface for a sheet or sheets of material such as, for example, paper, to be delivered by the drum 100 to the subsequent device, due to the rotation of the drum 100.

A rigid gripper element 108 is mechanically linked to a gripper arm 110, that is, in turn, movably mounted to a shaft 112 received in the drum 100. As shown in the exemplary embodiment of the present invention illustrated in FIG. 1, the shaft 112 is mounted in the drum 100 such that movement of the rigid gripper element 108 causes the gripper arm 110 to rotate about the shaft 112.

In this manner, a sheet received upon the seat 106, and moved laterally toward the edge of the gripper 108 is received under the edge of the gripper 108. This results in movement of the gripper 108 away from the surface of the drum 100, and causes a rotation of the gripper arm 110, with the gripper 108 pinching down on the sheet for movement with the drum 100, as will be explained in further detail with respect to FIG. 2.

Pursuant to a feature of an exemplary embodiment of the present invention, a linear slide 114 is mounted to the drum 100. The linear slide 114 is arranged on the drum 100, adjacent to the gripper 108 and gripper arm 110, as shown in FIG. 1. Accordingly, the linear slide 114 rotates with the drum 100. A linear bushing 116 is slidably mounted on the linear slide 114. The linear bushing 116 is arranged to mount a curved target 118 for linear movement with the linear bushing 116 along the length of the linear slide 114.

According to a further feature of the exemplary embodiment of the present invention, an intermediate arm 120 extends from the linear bushing 116 to a mechanical linkage 122 with the gripper arm 110. The mechanical linkage 122 causes the linear bushing 116 to slide along the linear slide 114 via the intermediate arm 122, when movement of the gripper 108 rotates the gripper arm 110.

In this manner, the target 118 slides along the length of the linear slide 114, as a function of the movement of the gripper 108. The amount of movement of the gripper 108 is, in turn, a function of the thickness of the sheet received under the edge of the gripper 108, as will appear. Thus, the position of the target 118 on the linear slide 114 represents the thickness of the sheet gripped by the gripper 108. The position of the target 118 changes as and when a sheet is inserted under the edge of the gripper 108.

In order to utilize the target position information as an indication of sheet thickness, a distance sensor 124 is arranged adjacent to the rotating drum 100, in a position such that the target 118 passes beneath the distance sensor 124 a predetermined time or at a downstream location after insertion of a sheet under the edge of the gripper 108, as shown in FIG. 1. The predetermined time between insertion of a sheet under the edge of the gripper 108, and the passing of the target 118 beneath the distance sensor 124 is set to minimize any angular delay between the insertion of a sheet, and measuring operation of the distance sensor 124, while assuring accurate operation. The distance sensor 124 can be mounted on a frame supporting the support shaft 102, as is generally known in the art, and comprise, for example, a photo detector to measure the distance of the distance sensor 124 from the surface of the target 118 as it rotates past the distance sensor 124. The distance sensor 124 is, therefore, mounted such that photo detector beams emitted by the distance sensor 124 are reflected off the surface of the target 118 as it rotates past the distance sensor 124.

To advantage, the surface of the target 118 is curved to enable an accurate distance reading. The operation of the distance sensor 124 is synchronized to the rotation of the drum 100 so as to emit photo detector beams and receive reflections from the surface of the target 118, as the target 118 passes the distance sensor 124 during rotation of the drum 100. The distance sensor 124 operates to generate electrical signals as a function the time between emission and reception of the photo detector beams. As should be understood, the signal strength will be a function of the position of the target 118, and therefore be proportional to the thickness of a sheet gripped by the gripper 108.

In accordance with an exemplary embodiment of the present invention, the distance sensor 124 is coupled to a measuring device, such as a PC 126. The PC 126 is programmed to receive and display the electrical signals received from the distance sensor 124.

Figure 2:
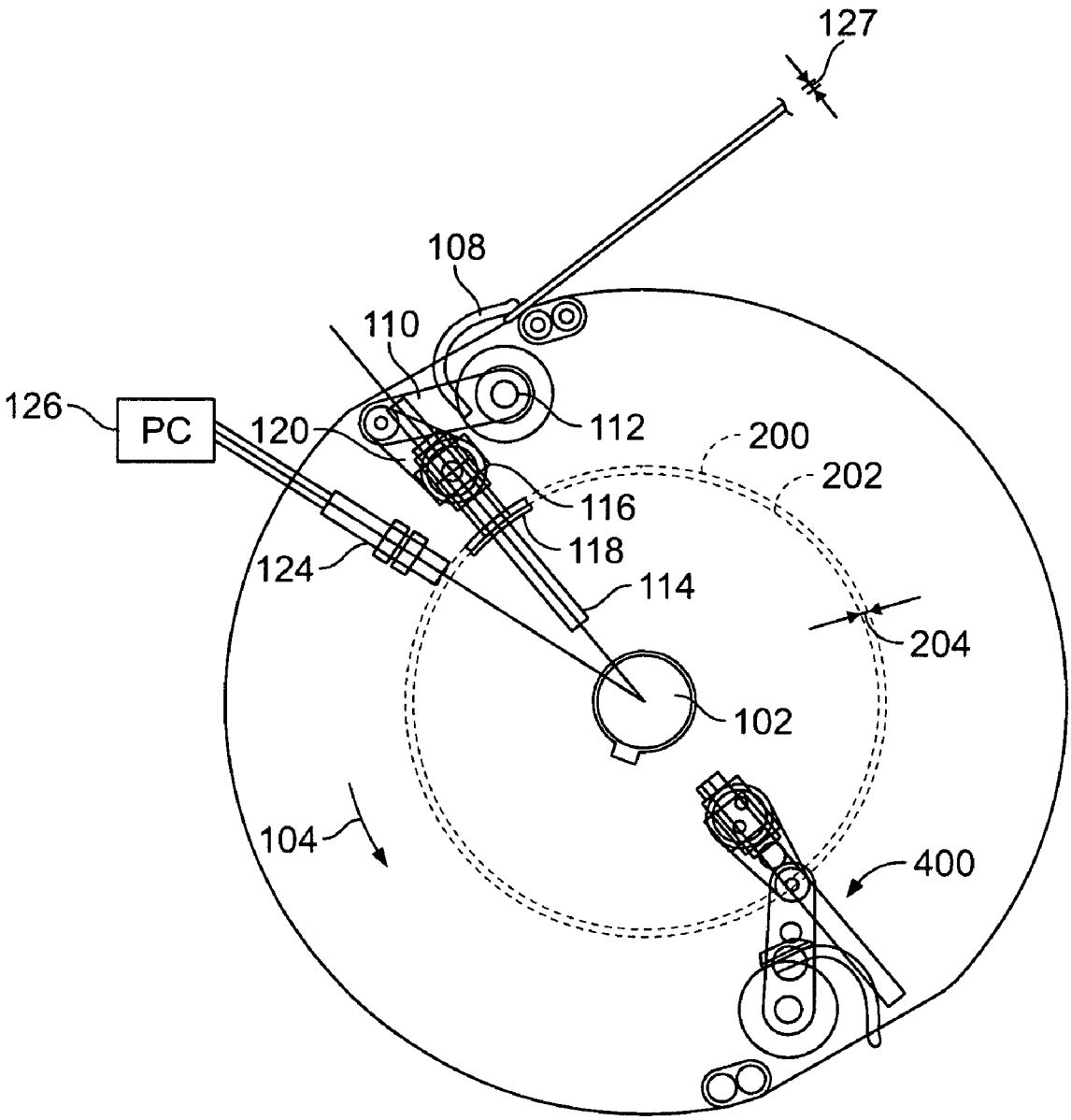
FIG. 2 is a side view of the rotating cylinder of FIG. 1 with a sheet gripped by the cylinder, and illustrating the operation of the paper thickness measuring device.

Referring now to FIG. 2, the rotating cylinder drum 100 of FIG. 1 is illustrated with a sheet 126 gripped by the drum 100. As shown in FIG. 2, the sheet 126 causes the edge of the gripper 108 to be displaced from the surface of the drum 100, causing the gripper 108 to rotate the gripper arm 110 about the shaft 112. The rotation of the gripper arm 110 pushes down on the intermediate arm 120, which, in turn, displaces the linear bushing 116 along the length of the linear slide 114. This action displaces the target 118 toward the support shaft 102.

When the edge of the gripper 108 engages the surface of the drum 100 (see FIG. 1), the target 118 is located at a position 200, as shown in FIG. 2. This position corresponds to a "No Sheet" level or position. After displacement of the target 118 by action of the movement of the gripper 108 due to insertion of a sheet under the edge of the gripper 108, the target 118 is located at another position 202, which corresponds to a "Measured Sheet" level or position. The spacing 204 between the positions 200, 202 corresponds to the thickness of the sheet.

As described above, as the drum 100 rotates in the direction 104, the target 118 periodically passes beneath the distance sensor 124. The operation of the distance sensor 124 is synchronized to the rotation frequency of the target 118. The distance sensor 124 emits a series of photo detector beams toward the target 118 when the target 118 is beneath the distance sensor 124, and receives the reflections of the beams off the target surface. The distance sensor 124 measures the time it takes for the reflections to return, and translates that time into corresponding distance measurement electrical signals for transmission to the PC 126.

Figure 3:
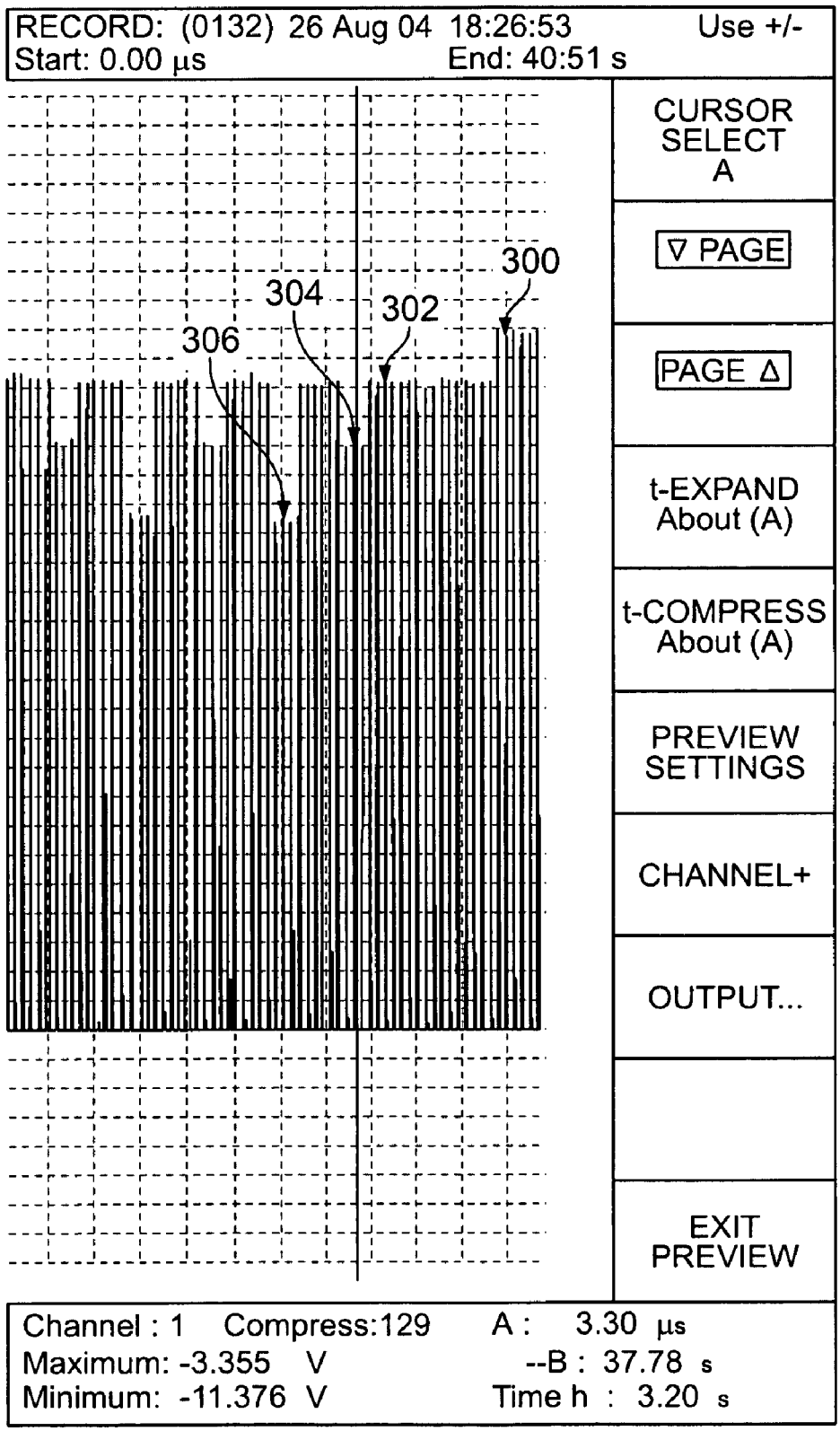
FIG. 3 shows a data output graph of the paper thickness measuring device, and indicating data for various numbers of gripped pages.

As illustrated in FIG. 3, a data output graph shows representations of electrical signals generated by the distance sensor 124 as a function of the time between emission and reception of the photo beams. Each of the signals corresponds to the time between emission and reception of the photo detector beams. When the gripper 108 is resting against the surface of the drum 100, the target 118 is at the No Sheet position 200, and the distance sensor 124 generates signals 300 at a first signal level corresponding to a NO Sheet condition, while the target 118 passes beneath the distance sensor 124.

When a single sheet of paper is inserted under the gripper 108, the target is displaced to a Measured Sheet level 202 corresponding to generated signals 302, at a second signal level representative of a single sheet of paper.

Similarly, when multiple sheets are inserted under the gripper, signals 304, 306, at differing signal levels, are generated by the distance sensor 124. The signals 304 correspond to two sheets of paper, while the signals 306 correspond to three sheets, and so on.

The signals illustrated in FIG. 3 may comprise a display at the PC 126. The PC 126 is programmed to display and process the signals 300,302,304,306 received from the distance sensor 124. The PC 126 generates a visual display for a user, as illustrated in FIG. 3, and may also generate an alert or cause the drum 100 to stop operation when the number of pages measured is different from the number of pages meant to be delivered by the drum 100.

A similar gripper-linear slide arrangement 400 can be mounted diametrically opposed to the gripper 108, for gripping and measuring two sheets per rotation of the drum 100.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. For use in a rotary paper feeding device having a rotating cylindrical drum, a paper thickness measuring device, comprising:

a gripper mounted on the cylindrical drum for gripping a sheet;

a target mounted on the cylindrical drum and mechanically linked to the gripper such that a position of the target corresponds to displacement of the gripper by a gripped sheet, the target being arranged and configured for detection of the target position at a predetermined time or at a downstream location after the gripper grips a sheet; and a linear slider mounted on the cylindrical drum and a linear bushing mechanically linked to the gripper and slidably mounting the target on the linear slider to position the target along the length of the linear slider as a function of the displacement of the gripper.

2. The paper measuring device of claim 1, further comprising a gripper arm movably mounted to the cylindrical drum, and mechanically linked to the gripper for movement as a function of displacement of the gripper by a gripped sheet, the target being mechanically linked to the gripper arm.

3. The paper measuring device of claim 1, further comprising a distance sensor mounted adjacent to the rotating cylindrical drum for measuring the target position at the predetermined time after the gripper grips a sheet.

4. A rotary paper feeding device, comprising:

a rotating cylindrical drum;

a gripper mounted on the cylindrical drum for gripping a sheet;

a target mounted on the cylindrical drum and mechanically linked to the gripper such that a position of the target corresponds to displacement of the gripper by a gripped sheet, the target being arranged and configured for detection of the target position at a predetermined time or at a downstream location after the gripper grips a sheet; and a linear slider mounted on the cylindrical drum and a linear bushing mechanically linked to the gripper and slidably mounting the target on the linear slider to position the target along the length of the linear slider as a function of the displacement of the gripper.

5. The rotary paper feeding device of claim 4, further comprising a gripper arm movably mounted to the cylindrical drum, and mechanically linked to the gripper for movement as a function of displacement of the gripper by a gripped sheet, the target being mechanically linked to the gripper arm.

6. The rotary paper feeding device of claim 4, further comprising a distance sensor mounted adjacent to the rotating cylindrical drum for measuring the target position at the predetermined time after the gripper grips a sheet.

7. A method for measuring the thickness of a sheet being gripped by a rotary paper feeding device, comprising the steps of:

providing a rotating cylindrical drum;

providing a gripper mounted on the cylindrical drum for gripping a sheet such that the gripper is displaced upon gripping a sheet;

mechanically linking the gripper to a target mounted on a linear slider mounted on the cylindrical drum to cause a position of the target to correspond to displacement of the gripper by a gripped sheet; and arranging the target for detection of the target position at a predetermined time or at a downstream location after the gripper grips a sheet.

8. The method of claim 7 comprising the further step of providing a distance sensor mounted adjacent to the rotating cylindrical drum for measuring the target position at the predetermined time after the gripper grips a sheet.

9. For use in a rotary paper feeding device having a rotating cylindrical drum, a paper thickness measuring device, comprising:

a gripper mounted on the cylindrical drum for gripping a sheet; and a target mounted on the cylindrical drum and mechanically linked to the gripper such that a position of the target corresponds to displacement of the gripper by a gripped sheet, the target being arranged and configured for detection of the target position at a predetermined time or at a downstream location after the gripper grips a sheet;

wherein the target slides radially in relation to the cylindrical drum when the gripper is displaced.

* * * * *